US007766617B1

(12) United States Patent
Liang

(10) Patent No.: US 7,766,617 B1
(45) Date of Patent: Aug. 3, 2010

(54) TRANSPIRATION COOLED TURBINE AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 819 days.

(21) Appl. No.: 11/715,045

(22) Filed: Mar. 6, 2007

(51) Int. Cl.
*F01D 5/08* (2006.01)

(52) U.S. Cl. ..... 416/97 R; 415/115; 415/200; 416/241 R; 416/241 B

(58) Field of Classification Search ..... 415/115, 415/200; 416/1, 97 R, 96 A, 241 R, 241 B
See application file for complete search history.

(56) References Cited

U.S. PATENT DOCUMENTS

| | | | | |
|---|---|---|---|---|
| 4,743,462 | A | 5/1988 | Radzavich et al. | |
| 5,195,243 | A | 3/1993 | Junod | |
| 5,249,357 | A | 10/1993 | Holmes et al. | |
| 5,498,133 | A | 3/1996 | Lee | |
| 5,690,473 | A | 11/1997 | Kercher | |
| 5,800,695 | A * | 9/1998 | Kang et al. | 205/135 |
| 5,981,088 | A | 11/1999 | Bruce et al. | |
| 6,004,620 | A | 12/1999 | Camm | |
| 6,214,248 | B1 | 4/2001 | Bowning et al. | |
| 6,280,140 | B1 * | 8/2001 | Soechting et al. | 416/97 R |
| 6,321,449 | B2 | 11/2001 | Zhao et al. | |
| 6,375,425 | B1 | 4/2002 | Lee et al. | |
| 6,379,118 | B2 | 4/2002 | Lutum et al. | |
| 6,427,327 | B1 | 8/2002 | Bunker | |
| 6,511,762 | B1 * | 1/2003 | Lee et al. | 428/697 |
| 6,582,194 | B1 * | 6/2003 | Birkner et al. | 416/97 R |
| 6,617,003 | B1 | 9/2003 | Lee et al. | |
| 6,726,444 | B2 * | 4/2004 | Zhao et al. | 415/115 |
| 6,905,302 | B2 * | 6/2005 | Lee et al. | 415/115 |

* cited by examiner

*Primary Examiner*—Igor Kershteyn
(74) *Attorney, Agent, or Firm*—John Ryznic

(57) ABSTRACT

A turbine airfoil or a substrate exposed to a high temperature environment having a plurality of modular formed cooling circuits with diffusion chambers and cooling holes for each module. Each module includes diffusion chambers and transpiration cooling holes and is placed on the airfoil substrate and a refractory material is formed over the modules. The modules are then leached away leaving the diffusion chambers and cooling holes formed between the substrate and the refractory coating.

18 Claims, 2 Drawing Sheets

TRANSPIRATION COOLED TURBINE AIRFOIL

BACKGROUND OF THE INVENTION

Field of the Invention

The present invention relates generally to fluid reaction surfaces, and more specifically to a turbine airfoil with film cooling holes.

Description of the Related Art including information disclosed under 37 CFR 1.97 and 1.98

A gas turbine engine includes a turbine section that has a plurality of stages of stator vanes and rotor blades reacting to a high temperature gas flow passing through the turbine to convert the chemical energy from combustion into mechanical energy by rotating the turbine shaft. The efficiency of the turbine, and therefore of the engine, can be increased by increasing the hot gas flow that enters the turbine.

To allow for higher turbine entrance temperatures, the upper stage vanes and blades are made from exotic nickel alloys that can withstand very high temperatures and have complex internal cooling air passages to provide cooling to these airfoils. A thermal barrier coating (TBC) is also applied to the airfoil surfaces exposed to the hot gas flow in order to provide further protection from the heat. A TBC is typically made from a ceramic material. Also, the TBC is typically applied after the film cooling holes have been drilled into the airfoil surface to provide for the film cooling. These film cooling holes are limited to the diameter because of the drilling process. Thicker TBC layers have been proposed to provide more protection to the airfoil substrate from the high temperature gas flow. As the TBC gets thicker, the thermal stresses developed in the TBC will tend to cause spalling.

In some prior art applications, a thin refractory coating is used in the turbine airfoil cooling design to provide a protective coating for the turbine airfoil and thus reduce the cooling flow consumption and improve turbine efficiency. The refractory coating is made of a material that is very expensive. The refractory coating is made so thin that cooling holes are not used in the coating because the hole length to diameter ratio cannot be larger than 2, which is required for cooling holes. Because the thin refractory coating is so thin—in the order of 2 to 4 mils (one mil is 0.001 inch)—the cooling hole would have to be at least 4 to 8 mils in diameter to maintain the hole ratio of 2 to 1.

As the turbine inlet temperature increases, the cooling flow demand for cooling the airfoil increases as well, and as a result the turbine efficiency is reduced. One alternative way for reducing the cooling air consumption while increasing the turbine inlet temperature for higher turbine efficiency is to use transpiration film cooling on the cooled thicker layer of the protective coating in order to reduce the heat load on the airfoil.

It is therefore an object of the present invention to provide for an improved high temperature resistant coating applied to a turbine airfoil.

It is another object of the present invention to provide for a high temperature resistant coating with smaller diameter film cooling holes.

It is another object of the present invention to provide for a refractory material coating on a turbine airfoil with smaller diameter cooling holes.

It is another object of the present invention to provide for a process of forming small diameter cooling holes in a refractory material using modules that form the holes.

BRIEF SUMMARY OF THE INVENTION

The present invention is a turbine airfoil with a refractory coating applied to the surface in which the coating includes small diameter cooling holes formed therein. The cooling holes are formed by placing a module of a leachable ceramic material into trenches already formed within the surface of the airfoil substrate. The module includes an array of trusses extending chordwise and spanwise, each truss having a plurality of hole forming extensions to form the cooling holes. The module is placed within the trenches formed on the blade substrate, a refractory coating is applied over the module, and the module is leached away leaving the cooling holes and the diffusion openings formed within the refractory coating.

DETAILED DESCRIPTION OF THE INVENTION

Figure 1:
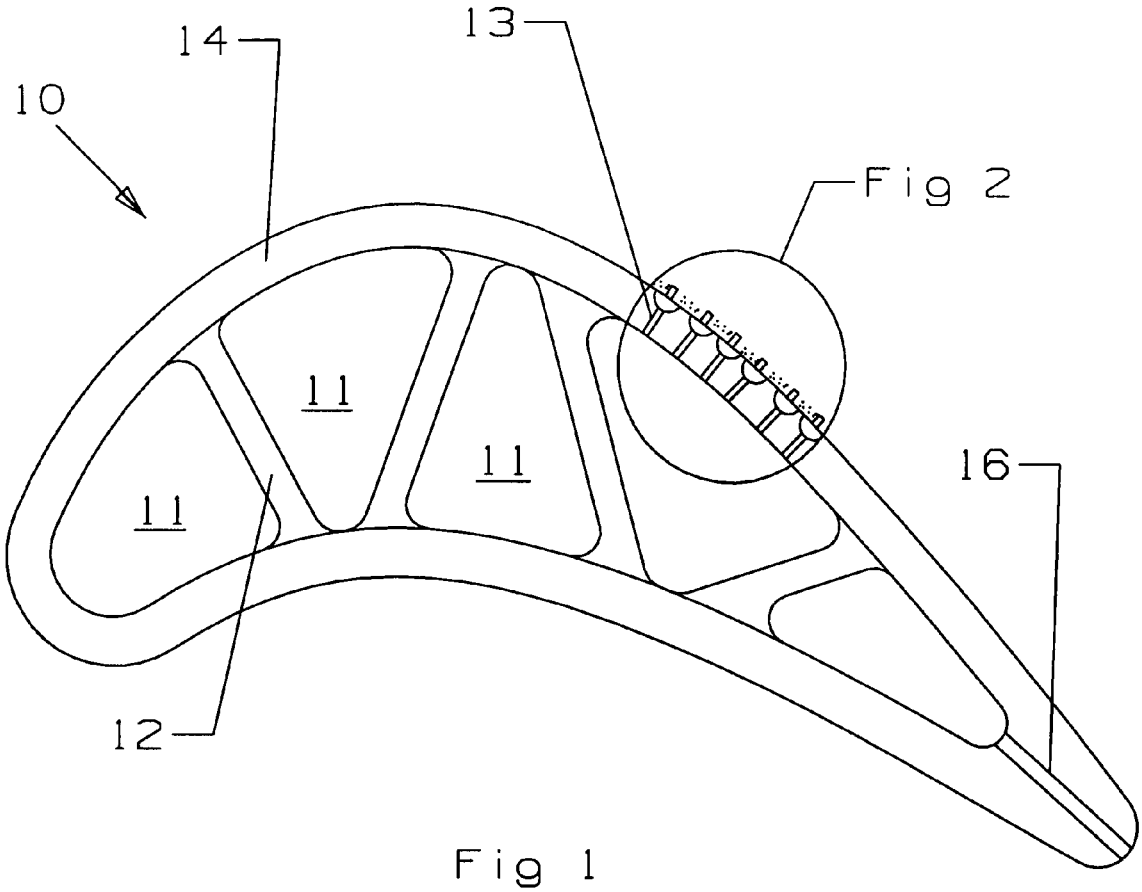
FIG. 1 shows a top view of a cross section of a turbine blade with the cooling holes of the present invention.

The present invention is a turbine airfoil, such as a rotor blade or a stator vane, used in a gas turbine engine, in which the turbine airfoil includes a thick refractory coating to provide protection form a higher external gas flow temperature than would a typical ceramic TBC used on the airfoil. The airfoil 10 in the present invention is shown in FIG. 1 and has a leading edge and a trailing edge, and a pressure side and a suction side. Internal cooling air supply channels 11 are formed within the airfoil walls and are separated by ribs 12 that also reinforce the airfoil walls. Exit cooling holes 16 are located in the trailing edge of the blade 10 and discharge cooling air from the downstream channel of the blade. Cooling holes 13 are formed in the main wall or substrate 14 of the blade and connect the internal cooling air supply channels to the cooling holes of the present invention best described in FIG. 2.

Figure 2:
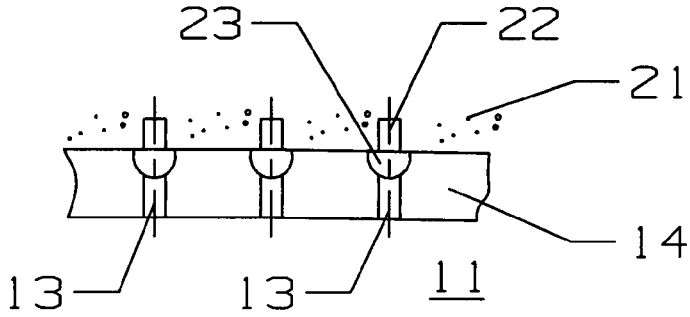
FIG. 2 shows a close-up view of the cooling holes of FIG. 1.

FIG. 2 shows the details of the small cooling holes formed in the coating applied to the outer surface of the airfoil on the substrate 14. Cooling supply holes 13 are formed in the substrate by any of the well known processes such as drilling. The cooling holes 13 function as metering holes for the individual cooling holes 22 that are formed within the coating 21. Each cooling supply hole 13 ends into a diffusion chamber 13 that is also formed within the substrate 14. The cooling holes 22 connect the diffusion chamber 23 to the exterior surface of the coating 21.

Figure 3:
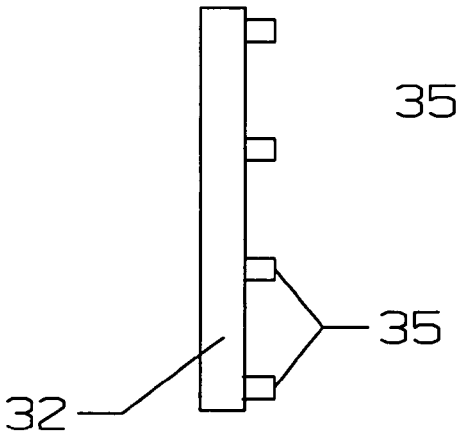
FIG. 3 shows a side view of one of the modules used to form the cooling holes of the present invention.
Figure 4:
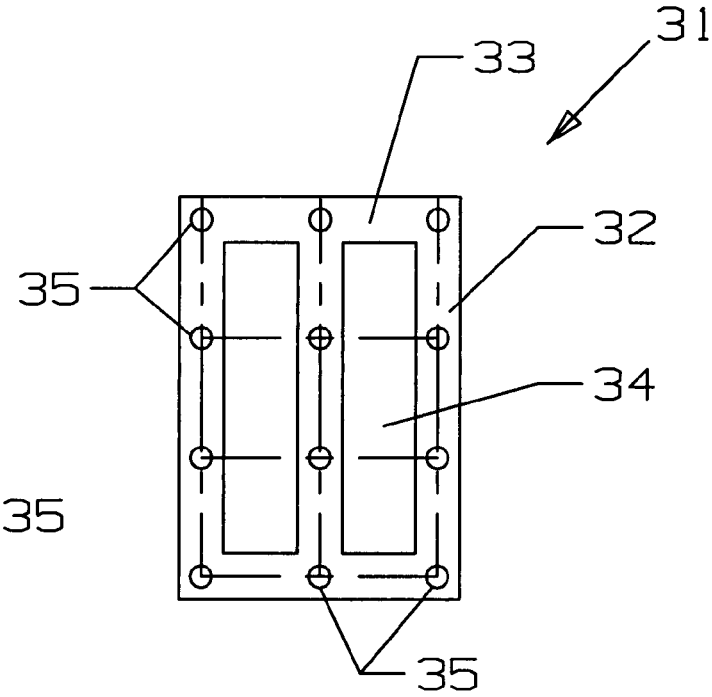
FIG. 4 shows a top view of the module of FIG. 3.

The cooling holes 22 are formed into the coating 21 by a process that uses a plurality of modules or mini cores 31 shown in FIGS. 3 and 4 that form a number of the cooling holes 22 in the coating 21. The module or mini core 31 is rectangular in shape and includes core trusses that extend in the vertical and horizontal directions as seen in FIG. 4. Two horizontal trusses 33 and three vertical trusses 32 form a rectangular shaped module with two openings 34 inside. Cooling hole shaped pins 22 extend from the flat surface of the trusses the length equal to about that of the thickness of the coating to be applied. One metering hole 13 would supply cooling air to the diffusion chamber formed by one of the vertical trusses 32 of the module 31 shown in FIG. 4. Thus, the module 31 shown in FIG. 4 would be associated with three metering holes 13 with one metering hole for each of the three vertical trusses 32. The substrate 14 has an arrangement of trenches machined or cast into the blade wall and having a spherical cross sectional shape as seen in FIG. 2. The size and shape of the trenches formed in the substrate 14 will be the same as the module or min core 31, since the module will be placed into the trenches before the coating is applied. The module or mini core 31 is made of a leachable ceramic material of the kind used to form hollow turbine airfoils with internal cooling passages using the lost wax process.

To produce the turbine blade (or stator vane), the blade is cast and the trenches that will form the diffusion chamber 23 will be machined into the blade substrate or cast with the blade. The blade substrate thus has an array of trenches formed in the shape of the module 31 shown in FIG. 4 in which three vertical or primary trenches extend between two horizontal or secondary trenches with three metering holes 13 drilled in the substrate at about the midpoint of each of the three vertical or primary trenches. The primary trenches include a metering hole connected to the trench. The secondary trenches connect two adjacent primary trenches. The metering holes 13 for each of the trenches that form the diffusion chamber 23 are drilled into the blade to connect the trench to the cooling supply channel 11. Primary diffusion chambers are formed from the vertical or primary trenches, and secondary diffusion chambers are formed from the horizontal or secondary trenches. The modules 31 are placed within the trenches such that the outer substrate surface and the top surface of the modules are flush. The cooling hole forming pins 35 extend outward in the size and length of the cooling holes that will be formed later. The coating 21 is applied to the substrate with all of the modules 31 in place. When the coating is dried, the ceramic material that forms the modules is leached out. With the ceramic material leached out, the diffusion chamber 23 and the cooling hole 22 remains and forms the cooling air passage from the metering hole 13 to the opening on the surface of the coating 21. In the present embodiment, the coating is a refractory material such as Iridium or Rhodium that can withstand higher gas flow temperatures than the typical ceramic thermal barrier coatings. Thus, a turbine airfoil with the refractory coating and the small diameter cooling holes can produce transpiration cooling of the airfoil that will allow for exposure to the higher gas flow temperatures. This will allow for a gas turbine engine with a higher turbine inlet temperature, which will provide for higher engine efficiency. Also, because of the small cooling holes that will allow transpiration cooling for the refractory coating, the refractory coating can be thicker than a non-cooled refractory coating. The thicker refractory coating will also provide for additional protection to the blade substrate from the extreme gas flow temperature. In the present invention, the refractory coating has a thickness of about 0.005 inches to 0.008 inches. With a thickness in the smaller range of 0.005 inches, to keep a cooling hole length to diameter ratio of 2, the diameter of the cooling hole would have to be 0.0025 inches. The process of forming cooling holes of the present invention is capable of forming cooling holes of this small diameter.

FIG. 4 shows the grid of trench forming trusses extending in a vertical and horizontal direction with openings 34 formed between the trusses that are in the shame shape and size as the trenches on the blade substrate. The present invention shows three vertical trenches and two horizontal trenches. However, this could be rotated 90 degrees without departing from the spirit and scope of the present invention. Also, instead of the trusses forming a rectangular array or grid, a triangular array or grid can be used. Three trenches in which the two side trenches could extend at about 30 degrees from the normal while the base trench would connect the two. The metering holes would be associated with the longer side trenches, with the base trench acting as the secondary diffuser connecting the two primary diffusers together.

FIG. 1 shows a portion of the airfoil wall to include the cooling holes with diffusion chambers as described in the present invention above for the purpose of clarity. However, the entire airfoil wall from the leading edge to the trailing edge along the pressure side and the suction side includes the cooling holes.

I claim the following:

1. A turbine airfoil used in a gas turbine engine, the airfoil having an internal cooling air channel to supply cooling air to the airfoil, the airfoil comprising:

a substrate forming a wall of the airfoil;

a metering hole to meter cooling air from the cooling air channel;

a diffusion chamber formed in the substrate in which the metering hole ends into the diffusion chamber;

a refractory coating applied over the substrate; and, a cooling hole extending through the refractory coating and connected to the diffusion chamber and opening onto the surface of the refractory coating, the cooling hole having a small diameter such that transpiration cooling is produced.

2. The turbine airfoil of claim 1 above, and further comprising:

the refractory coating has a thickness of about 0.010 inches to about 0.020 inches.

3. The turbine airfoil of claim 1 above, and further comprising:

the refractory coating comprises Iridium or Rhodium.

4. The turbine airfoil of claim 1 above, and further comprising:

the diffusion chamber extends along the substrate and forms a primary diffusion chamber; and, a plurality of cooling holes extend from the diffusion chamber and opens onto the surface of the refractory coating.

5. The turbine airfoil of claim 4 above, and further comprising:

a second primary diffusion chamber spaced the first primary diffusion chamber;

a plurality of cooling holes extending from the second primary diffusion chamber and opening onto the surface of the refractory coating;

a metering hole connected to the second primary diffusion chamber to meter cooling air; and, at least one secondary diffusion chamber connecting the two adjacent primary diffusion chambers such that cooling air can flow between the two adjacent primary diffusion chambers.

6. The turbine airfoil of claim 5 above, and further comprising:

the primary diffusion chambers and the secondary diffusion chambers form a grid with substantially vertical and horizontal extending chambers.

7. A turbine airfoil used in a gas turbine engine, the airfoil having an internal cooling air channel to supply cooling air to the airfoil, the airfoil comprising:

an airfoil substrate forming an inner surface and an outer surface;

a primary diffusion chamber formed on the outer surface of the substrate and extending along a first direction;

a metering hole connecting the inner surface of the substrate to the primary diffusion chamber;

a secondary diffusion chamber formed on the outer surface of the substrate and extending along a secondary direction not parallel to the first direction, the secondary diffusion chamber being connected to the primary diffusion chamber;

a thermal barrier coating applied over the substrate and the diffusion chambers; and, a plurality of cooling holes formed in the coating and connected to the primary diffusion chamber.

8. The turbine airfoil of claim 7 above, and further comprising:

a series of primary and secondary diffusion chambers forming a grid;

each primary diffusion chamber being connected to the substrate inner surface by at least one metering hole; and, each primary diffusion chamber being connected to a row of cooling holes opening onto the surface of the coating.

9. The turbine airfoil of claim 8 above, and further comprising:

the grid is substantially a rectangular grid.

10. The turbine airfoil of claim 7 above, and further comprising:

the coating is a refractory coating; and, the cooling holes are of small diameter such that transpiration cooling occurs.

11. The turbine airfoil of claim 10 above, and further comprising:

the refractory coating is from about 0.010 inches to about 0.020 inches thick.

12. The turbine airfoil of claim 10 above, and further comprising:

the refractory coating comprises Iridium or Rhodium.

13. The turbine airfoil of claim 9 above, and further comprising:

two secondary diffusion chambers connect the ends of the primary diffusion chambers;

a third primary diffusion chamber extending between the secondary diffusion chamber; and, the third primary diffusion chamber being connected to a row of cooling holes opening onto the surface of the coating.

14. A process of producing a turbine airfoil having transpiration cooling comprising the steps of:

forming at least two primary trenches in the form of primary diffusion chambers on an outer surface of the airfoil substrate;

forming at least one secondary trench in the form of a secondary diffusion chamber;

drilling at least one metering hole into the substrate to connect each of the primary trenches to the inner surface of the substrate;

placing a mini core of a leachable material into the trenches, the mini core having cooling hole forming projections;

forming a refractory coating over the mini core and the substrate such that the coating leaves a portion of the cooling hole forming projections extending out from the coating; and, leaching away the mini core material to leave the diffusion chambers and the cooling holes in the coating.

15. The process of producing a turbine airfoil of claim 14, and further comprising the step of:

forming the trenches in the substrate in the form of modules such that modular mini cores can be placed in the trenches to form the cooling holes.

16. The process of producing a turbine airfoil of claim 15 and further comprising the step of:

forming the trenches into a substantially rectangular grid.

17. The process of producing a turbine airfoil of claim 14, and further comprising the step of:

forming the coating with a thickness of from about 0.010 inches to about 0.020 inches.

18. The process of producing a turbine airfoil of claim 14, and further comprising the step of:

forming the cooling holes of such small diameter that transpiration cooling occurs.

* * * * *